United States Patent [19]

Ueda et al.

[11] Patent Number: 4,847,537

[45] Date of Patent: Jul. 11, 1989

[54] APPARATUS FOR STARTING AND OPERATING A DISCHARGE LAMP

[75] Inventors: Akihiro Ueda, Yokohama; Fuminori Nakaya, Yokosuka; Kouhei Yuhara; Nanjou Aoike, both of Yokohama, all of Japan

[73] Assignee: Kabushiki Kaisha Toshiba, Kawasaki, Japan

[21] Appl. No.: 186,665

[22] Filed: Apr. 20, 1988

Related U.S. Application Data

[63] Continuation of Ser. No. 925,614, Oct. 31, 1986, abandoned.

[30] Foreign Application Priority Data

Nov. 6, 1985 [JP] Japan ..... 60-248324

[51] Int. Cl.[4] ..... H05B 41/24

[52] U.S. Cl. ..... 315/200 R; 315/243; 315/244; 315/276; 315/278

[58] Field of Search ..... 315/200 R, 209 R, 242, 315/243, 244, DIG. 2, DIG. 5, 278, 276

[56] References Cited

U.S. PATENT DOCUMENTS

| | | | |
|---|---|---|---|
| 4,127,797 | 11/1978 | Perper | 315/209 R |
| 4,259,614 | 3/1981 | Kohler | 315/244 X |
| 4,277,728 | 7/1981 | Stevens | 315/247 X |
| 4,544,862 | 10/1985 | Yamazaki et al. | 315/209 R |
| 4,572,989 | 2/1986 | Zuchtreigel | 315/209 X |
| 4,608,523 | 8/1986 | Nilssen | 315/244 |
| 4,641,061 | 2/1987 | Munson | 315/210 |

FOREIGN PATENT DOCUMENTS

| | | | |
|---|---|---|---|
| 57-141895 | 9/1982 | Japan | 315/244 |
| 61-2299 | 1/1986 | Japan | 315/106 |

*Primary Examiner*—Edward L. Coles, Sr.
*Assistant Examiner*—Mark R. Powell
*Attorney, Agent, or Firm*—Oblon, Spivak, McClelland, Maier & Neustadt

[57] ABSTRACT

An apparatus for starting and operating a discharge lamp includes an inverter circuit. The inverter circuit comprises a parallel resonance circuit including an oscillation coil and capacitor, and which is connected to the discharge lamp, via a current-limiting coil, a switching transistor for triggering the parallel resonance circuit, and a feedback circuit connected to the switching transistor, for allowing a feedback signal for driving the switching transistor to be supplied to the base of the switching transistor, the feedback circuit being magnetically coupled to the current-limiting coil.

13 Claims, 3 Drawing Sheets

APPARATUS FOR STARTING AND OPERATING A DISCHARGE LAMP

This application is a continuation of application Ser. No. 925,614, filed Oct. 31, 1986, now abandoned.

BACKGROUND OF THE INVENTION

1. Field of the Invention

This invention relates to an apparatus for starting and operating a discharge lamp, using an inverter circuit.

2. Description of Background

An apparatus for starting and operating a discharge lamp, equipped with an inverter circuit has generally been used so as to achieve a small-sized unit with an improved efficiency. Japanese Patent Disclosure (KOKAI) No. 57-141895 discloses a conventional apparatus for starting and operating a discharge lamp. According to the invention, an AC power source is connected to a rectifier circuit including a rectifier and a smoothing capacitor, the output of the rectifier circuit being connected to an inverter circuit. The inverter circuit includes a parallel resonance circuit of an oscillation transformer and capacitor connected in parallel with a primary winding of the oscillation transformer. The resonance circuit is driven by a switching transistor. Between the base and the emitter of the transistor, a series circuit of a coupling capacitor and feedback coil magnetically coupled to the oscillation transformer is connected as a feedback circuit, via a diode. A series circuit of a diode and resistor is connected in parallel with the series circuit of the coupling capacitor and feedback coil, and a trigger resistor is connected in series with both the series circuits.

A discharge lamp is connected to a secondary coil of the oscillation transformer, via a current-limiting coil, and a starting circuit is comprised of a series circuit of diodes and silicon symmetrical switch element, and is connected in parallel with a discharge lamp.

According to the aforementioned apparatus for starting and operating a discharge lamp, since the starting circuit includes a series circuit of diodes and a silicon symmetrical switch element, a high-voltage pulse to be generated is regulated by the diode characteristic. It is, therefore, not possible to obtain an adequate high-voltage pulse.

SUMMARY OF THE INVENTION

It is accordingly an object of this invention to provide an apparatus for starting and operating a discharge lamp for generating a high-voltage of sufficiently high level.

The device of this invention includes a resonance circuit having an oscillation transformer and capacitor connected in parallel with the primary coil of the oscillation transformer. A discharge lamp is connected, via a choke coil, to the output of the inverter, and a starting capacitor is connected in parallel with the discharge lamp.

A series circuit comprised of a feedback coil magnetically coupled to the choke coil, and a coupling capacitor connected in series with the feedback coil is fed back to a switching transistor in the inverter circuit.

DETAILED DESCRIPTION OF THE PREFERRED EMBODIMENTS

Figure 1:
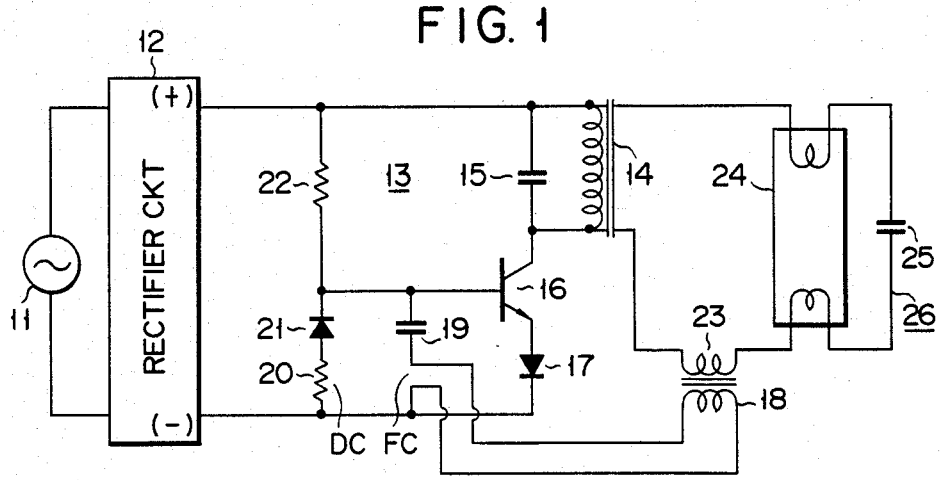
FIG. 1 is a circuit diagram showing an apparatus for starting and operating a discharge lamp according to one embodiment of this invention.

In the embodiment shown in FIG. 1, rectifier circuit 12 having a rectifier and a filter is connected to AC power source 11, and inverter circuit 13 is connected to rectifier circuit 12.

Inverter circuit 13 includes a parallel resonance circuit comprised of oscillation coil (oscillation choke coil) 14, and capacitor 15 connected in parallel with oscillation coil 14. The resonance circuit is connected at one terminal to a plus terminal of rectifier circuit 12 and at the other terminal to the collector of switching transistor (switching element) 16. The emitter of transistor 16 is connected to a minus terminal of rectifier circuit 12, via diode 17. A feedback circuit FC having a series circuit of feedback coil 18 and capacitor 19 is connected between the minus terminal of the rectifier circuit and the base of transistor 16. A discharge circuit DC is connected in parallel with the series circuit of feedback coil 18 and capacitor 19, and includes a series circuit of resistor 20 and diode 21. The base of transistor 16 is connected to the plus terminal of the rectifier circuit, via starting resistor 22.

Discharge lamp 24 is connected, via current-limiting coil 23, to the output terminal of inverter circuit 13 and thus to oscillation choke coil 14. Starting circuit 26, including starting capacitor 25, is connected in parallel with the discharge lamp.

Figure 2:
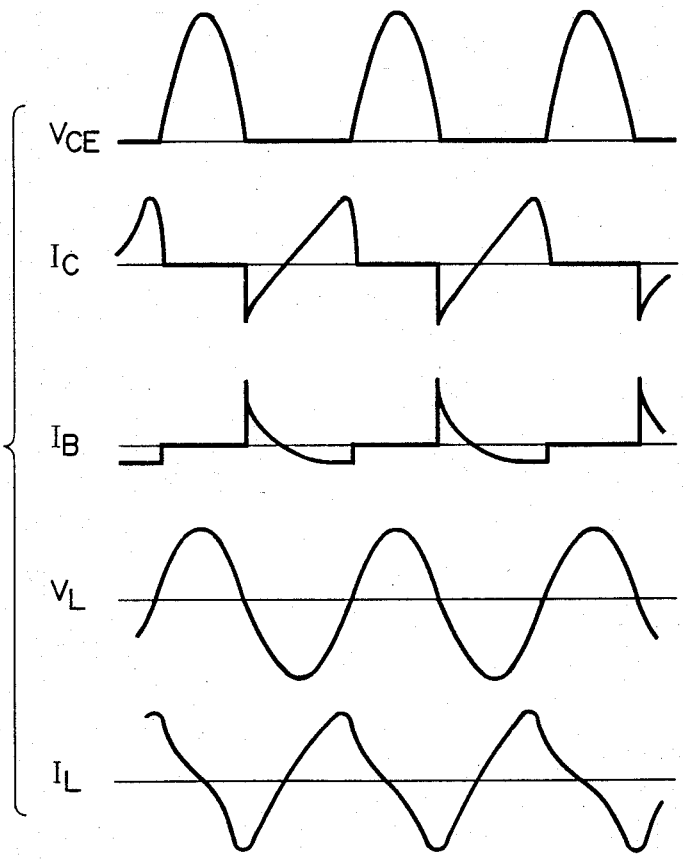
FIG. 2 is a time chart for explaining the operation of the apparatus for starting and operating a discharge lamp shown in FIG. 1.

In the aforementioned apparatus for starting and operating a discharge lamp, electromagnetic energy, stored in oscillation choke coil 14 when switching transistor 16 is turned off, undergoes a sine-wave oscillation in the parallel resonance circuit, producing a voltage $V_{CE}$ across the collector and emitter of transistor 16, as is shown in FIG. 2. A collector current $I_C$ flows through the collector of transistor 16 and, at this time, a base current $I_B$ flows through the base of the transistor.

Since, at the starting time of discharge lamp 24, the impedance of lamp 24 is regarded as being infinite, a series resonance circuit is created by current-limiting coil 23 and starting capacitor 25. When the frequency of the series resonance circuit approximates to that of the parallel resonance circuit of oscillation choke coil 14 and capacitor 15, then, an apparent impedance of the series resonance circuit approximates to zero. As a result, a large current flows through the series resonance circuit. At this time, the following equation holds:

$$V_{L1}=(j\omega L+1/j\omega C+R')I_L=(\omega L+1/j\omega)I_L+R'I_L$$

where $V_{L1}$ is the output of inverter circuit 13;

$I_L$ is the output current;

L is the inductance of current limiting coil 23;

C is the capacitance of capacitor 25; and

R′ is the resistance of the filament of discharge lamp 24, provided that the resistance R′ is a small resistance of less than 100Ω.

When the output current $I_L$ flows through inverter circuit 13 in the series resonance, a voltage indicated by $$(1/j\omega C)\ I$$

is obtained. Thus, generation of a high voltage is possible.

At the time of starting of discharge lamp 24, a current $I_B$ flowing through the base of switching transistor 16 from coupling capacitor 19, due to the generation of a high voltage, is greater than a base current determined by a voltage applied to current-limiting coil 23 at a time of normal loading. Thus, more current $I_L$ can flow through inverting circuit 13 at the time of starting of discharge lamp 24 than at the normal operation time of discharge lamp 24, due to the semiconductor characteristic, such as the amplification factor $h_{FE}$ of switching transistor 16. The output voltage $V_L$ and output current $I_L$, at the time of starting, are obtained as the outputs of inverter circuit 13, as is shown in FIG. 2.

In the conventional apparatus for starting and operating a discharge lamp, for example, the voltage $V_{CE}$ is about 300V, and according to this invention, voltage $V_{CE}$ exceeds 400V. Furthermore, the base current $I_B$ is 0.2 A in the conventional device, and exceeds 2A according to this invention. The lamp application voltage somewhat exceeds 200V in the conventional device, and 500V according to this invention. The output current $I_L$ is 0.2 A in the conventional device, and about 2A according to this invention.

Since, as is set forth above, a larger current $I_L$ is obtained at the time of starting of discharge lamp 24, a high voltage can be applied to discharge lamp 24. A voltage is fed back to switching transistor 16 via feedback coil 18 which is magnetically coupled to current-limiting coil 23, thus presenting no problem with respect to, for example, a variation in the core, and magnetic saturation. A stabilized amount of feedback is obtained at the normal operation time of discharge lamp 24 in particular, thereby allowing stable lighting of discharge lamp 24.

Figure 3:
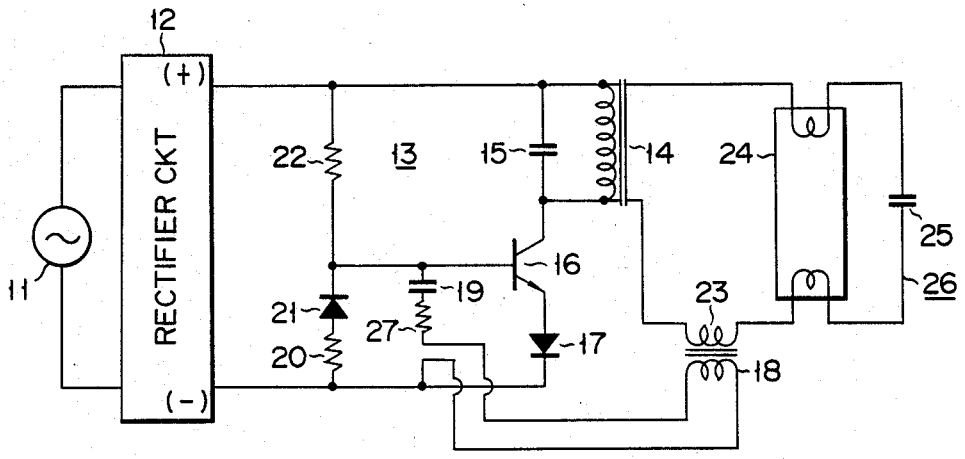
FIG. 3 is a circuit diagram showing an apparatus for starting and operating a discharge lamp of an another embodiment of this invention, including a series circuit of a capacitor and resistor in a feedback circuit.

Another embodiment of this invention will be explained below with reference to FIG. 3.

Resistor 27 constitutes one element of a series circuit including a feedback circuit FC of feedback 18 and coupling capacitor 19. An inrush current flowing through the base of switching transistor 16 is cut by resistor 27, so that the area of an overlap between the voltage waveform and the current waveform becomes smaller. As a result, the breakage of transistor 16 by the inrush current can be prevented and less electric current is dissipated as joule heat, so that the switching loss of the transistor can be reduced.

Figure 4:
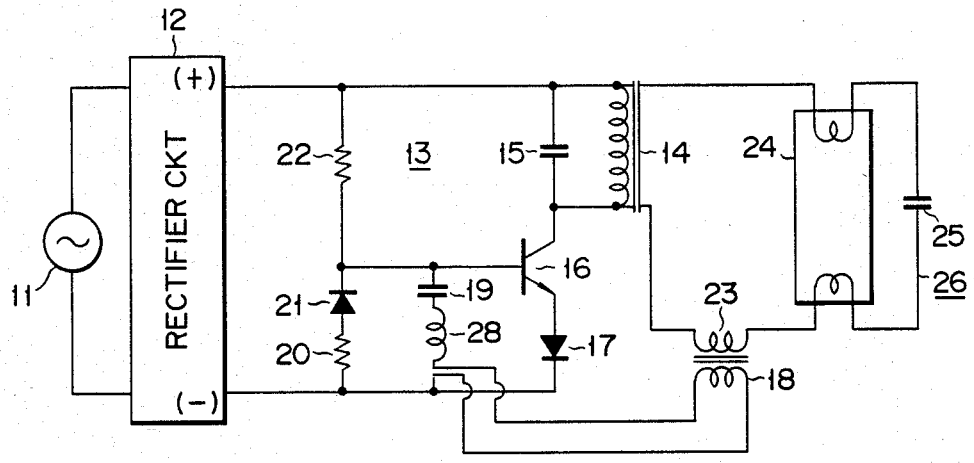
FIG. 4 is a circuit diagram showing an apparatus for starting and operating a discharge lamp according to another embodiment of this invention, including a series circuit of a capacitor and coil in a feedback circuit.

In another embodiment shown in FIG. 4, inductance coil 28 constitutes one element of a series circuit including a feedback circuit FC having of feedback coil 18 and capacitor 19. The base current $I_B$ is phase-lagged by coil 18 and an overlap between the waveform and the current waveform ceases to exist. As a result, the switching loss upon the turning-on of transistor 16 is reduced. Since a current flows through transistor 16 due to a resonance resulting from inductance coil 28 and coupling capacitor 19, a reverse current, which is supplied when transistor 16 is turned off, flows rapidly. It is therefore possible to reduce a switching loss involved when the transistor is turned off.

In the embodiment shown in FIG. 4, the amount of feedback is increased at the time of starting of discharge lamp 24, and thus, the use of a supersaturated inductor as inductance coil 28 is preferrable from the standpoint of, for example, the withstand voltage of the transistor.

Figure 5:
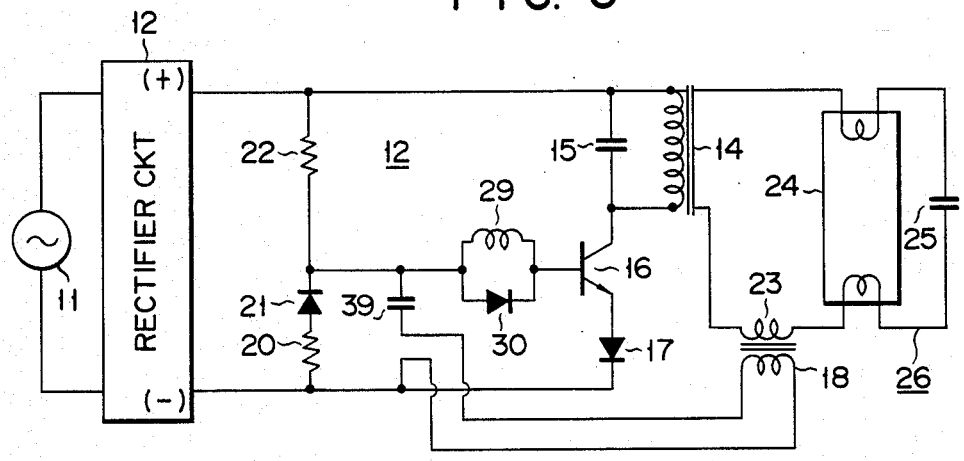
FIG. 5 is a circuit diagram showing an apparatus for starting and operating a discharge lamp according to another embodiment of this invention, including a parallel circuit of a coil and diode in a feedback circuit.

In another embodiment shown in FIG. 5, a parallel circuit of inductance coil 29 and diode 30 is connected between feedback circuit FC and the base of switching transistor 16. According to this embodiment, a pump current, produced when switching transistor 16 is transferred from an ON to an OFF state, is abruptly increased, due to a series resonance resulting from feedback coil 18 and coupling capacitor 19, thereby reducing the switching loss when the transistor is turned off. When, on the other hand, switching transistor 16 is transferred from the OFF to the ON state, a reversed replica of current $I_C$ flows through diode 30. As a result, a pump current is rapidly increased, due to a resonance resulting from feedback coil 18 and coupling capacitor 19, and thus the switching loss upon the turning-on of transistor is reduced. The inverted replica of current $I_C$ functions to reset coupling capacitor 19 at the time of preheating the discharge lamp, thus preventing an intermittent oscillation. It is therefore possible to deliver an adequate starting voltage from the inverting circuit.

Although, in the aforementioned embodiment, the choke coil has been explained as an oscillation coil, use may be made of a transformer-type oscillation coil, in which case it is preferable to use an insulation transformer.

According to this invention, the voltage transformer involving a large number of turns is used as a feedback coil for the feedback circuit, and it is therefore easier to perform an output control operation. Thus, the discharge lamp can be lighted in a stable fashion, without saturation of the feedback coil.

What is claimed is:

1. An apparatus for starting and operating a discharge lamp, comprising:

an inverter circuit connected to a DC power source, for generating an energy for starting and operating the lamp;

current-limiting coil means disposed between said inverter circuit and said lamp for limiting a current flowing through the lamp; and starting capacitor means connected in parallel with said discharge lamp, said starting capacitor means forming a first resonance circuit which is a serial resonance circuit in association with said current-limiting coil means when said discharge lamp is switched on;

wherein said inverter circuit comprises a second resonance circuit including an oscillation coil and a capacitor, a switching means coupled to said second resonance circuit for triggering said second resonance circuit, and feedback circuit means magnetically coupled to said current-limiting coil means, and electrically coupled to said switching means, for supplying a feedback signal to said switching means, thereby to drive said switching means in response to said feedback signal.

2. The apparatus for starting and operating a discharge lamp according to claim 1, in which said feedback circuit menas includes a feedback coil magnetically coupled to said current-limiting coil, and a capacitor connected in series with said feedback coil.

3. The apparatus for starting and operating a discharge lamp according to claim 2, in which said feedback circuit means includes a resistor which constitutes one element of a series circuit including said feedback coil and said capacitor.

4. The apparatus for starting and operating a discharge lamp according to claim 2, in which said feedback circuit means includes an inductor which constitutes one element of a series circuit including said feedback coil and said capacitor.

5. The apparatus for starting and operating a discharge lamp according to claim 2, in which said feedback circuit includes a parallel circuit of an inductor and diode which is connected in series with a series circuit of said feedback coil and said capacitor.

6. The apparatus for starting and operating a discharge lamp according to claim 3, in which said resistor is connected in series with said capacitor and said resistor.

7. The apparatus for starting and operating a discharge lamp according to claim 4, in which said inductor is connected in series with said capacitor and said resistor.

8. An apparatus for starting and operating a discharge lamp, comprising:

an inverter circuit connected to a DC power source for generating an energy for starting and operating the discharge lamp;

current-limiting coil means disposed between said inverter circuit and said lamp for limiting a current flowing through the lamp;

starting capacitor means connected in parallel with said discharge lamp, said starting capacitor means forming a first resonance circuit which is a serial resonance circuit in association with said current-limiting coil means when said discharge lamp is switched on;

wherein said inverter circuit comprises a second resonance circuit including an oscillation coil and a capacitor, a switching means coupled to said second resonance circuit for triggering said second resonance circuit, and feedback circuit means magnetically coupled to said current-limiting coil means and electrically coupled to said switching means, for supplying a feedback signal, corresponding to a voltage generated on said current limiting means, to said switching means, thereby to drive said switching means so that current suitable for starting and operating the lamp flows through said inverter circuit.

9. The apparatus for starting and operating a discharge lamp according to claim 8, in which said feedback circuit means includes a feedback coil magnetically coupled to said current-limiting coil, and capacitor means connected in series with said feedback coil.

10. The apparatus for starting and operating a discharge lamp according to claim 8, in which said feedback circuit means includes a feedback coil magnetically coupled to said current-limiting coil, and capacitor means and resistor means which are connected in series with said feedback coil.

11. The apparatus for starting and operating a discharge lamp according to claim 8, in which said feedback circuit means includes a feedback coil magnetically coupled to said current-limiting coil, and capacitor means and inductor means which are connected in series with said feedback coil.

12. The apparatus for starting and operating a discharge lamp according to claim 8, which includes a parallel circuit having an inductor and a diode connected in parallel to each other, which is connected between said switching means and said feedback circuit means.

13. The apparatus for starting and operating a discharge lamp according to claim 8, in which said second resonance circuit is a parallel resonance circuit having said oscillation coil and said capacitor, which are connected in parallel to each other.

* * * * *